US011501942B2

(12) United States Patent
Matus et al.

(10) Patent No.: US 11,501,942 B2
(45) Date of Patent: Nov. 15, 2022

(54) PTC DEVICE WITH INTEGRATED FUSES FOR HIGH CURRENT OPERATION

(71) Applicant: Littelfuse, Inc., Chicago, IL (US)

(72) Inventors: Yuriy Borisovich Matus, Pleasanton, CA (US); Martin G. Pineda, Fremont, CA (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/538,067

(22) Filed: Nov. 30, 2021

(65) Prior Publication Data

US 2022/0293384 A1 Sep. 15, 2022

Related U.S. Application Data

(60) Provisional application No. 63/161,095, filed on Mar. 15, 2021.

(51) Int. Cl.

| | |
|---|---|
| ***H01H 85/02*** | (2006.01) |
| ***H01C 7/02*** | (2006.01) |
| ***H01H 85/20*** | (2006.01) |
| ***H01H 85/055*** | (2006.01) |

(52) U.S. Cl.

CPC ..... *H01H 85/0241* (2013.01); *H01C 7/02* (2013.01); *H01H 85/055* (2013.01); *H01H 85/20* (2013.01)

(58) Field of Classification Search

CPC .. H01H 85/0241; H01H 85/055; H01H 85/22; H01C 7/02

See application file for complete search history.

(56) References Cited

U.S. PATENT DOCUMENTS

| | | | | |
|---|---|---|---|---|
| 5,663,702 | A * | 9/1997 | Shaw, Jr. | H01H 85/463 337/183 |
| 5,907,271 | A * | 5/1999 | Hirano | H01C 7/027 29/612 |
| 10,395,876 | B1 * | 8/2019 | Su | H01H 85/04 |
| 11,335,479 | B1 * | 5/2022 | Chen | H01C 7/028 |
| 2002/0125982 | A1 * | 9/2002 | Swensen | H01C 7/02 338/22 R |
| 2009/0027821 | A1 * | 1/2009 | Colby | H01C 7/02 361/104 |
| 2014/0049357 | A1 * | 2/2014 | Tseng | H01C 7/02 338/22 R |
| 2016/0099458 | A1 * | 4/2016 | Tanaka | H01M 10/0525 337/416 |
| 2017/0076900 | A1 * | 3/2017 | Iwai | H01H 85/36 |
| 2018/0315576 | A1 * | 11/2018 | Tsang | H01C 7/027 |
| 2021/0082652 | A1 * | 3/2021 | Kang | H01C 7/04 |

* cited by examiner

*Primary Examiner* — Jacob R Crum

(74) *Attorney, Agent, or Firm* — KDB Firm PLLC

(57) ABSTRACT

A circuit protection device including a PTC device having a PTC element, first and second electrodes disposed on opposing first and second surfaces of the PTC element, respectively, first and second chip fuses disposed on the first and second electrodes, respectively, the second chip fuse electrically connected in series with the PTC device, and the first chip fuse electrically in connected parallel with the PTC device and the second chip fuse, the first chip fuse having a lower electrical resistance than the PTC element when the PTC element is in a non-tripped state, wherein a fusible element of the first chip fuse has a first melting temperature and is configured to carry a current higher than the PTC element can carry without tripping, and wherein a fusible element of the second chip fuse has a second melting temperature that is greater than the first melting temperature.

20 Claims, 3 Drawing Sheets

PTC DEVICE WITH INTEGRATED FUSES FOR HIGH CURRENT OPERATION

CROSS-REFERENCES TO RELATED APPLICATIONS

This application claims the benefit of U.S. Provisional Patent Application No. 63/161,095, filed Mar. 15, 2021, which is incorporated by reference herein in its entirety.

BACKGROUND

Field

The present disclosure relates generally to the field of circuit protection devices. More specifically, the present disclosure relates to a circuit protection device that includes a positive temperature coefficient device and integrated fuses for facilitating high current operation and galvanic opening during extreme fault conditions.

Description of Related Art

Fuses are commonly used as circuit protection devices and are typically installed between a source of electrical power and a component in an electrical circuit that is to be protected. A conventional fuse includes a fusible element disposed within a hollow, electrically insulating fuse body. Upon the occurrence of a fault condition, such as an overcurrent condition, the fusible element melts or otherwise separates to interrupt the flow of electrical current through the fuse.

When the fusible element of a fuse separates as a result of an overcurrent condition, it is sometimes possible for an electrical arc to propagate through the air between the separated portions of the fusible element (e.g., through vaporized particulate of the melted fusible element). If not extinguished, this electrical arc may allow significant follow-on currents to flow to from a source of electrical power to a protected component in a circuit, resulting in damage to the protected component despite the physical opening of the fusible element.

One solution that has been implemented to eliminate electrical arcing in fuses is to replace the fusible element of a fuse with a positive temperature coefficient (PTC) element. A PTC element is formed of a PTC material composed of electrically conductive particles suspended in a non-conductive medium (e.g., a polymer). PTC materials exhibit a relatively low electrical resistance within a normal operating temperature range. However, when the temperature of a PTC material exceeds the normal operating temperature range and reaches a "trip temperature," such as may result from excessive current flowing through the PTC material, the resistance of the PTC material increases sharply. This increase in resistance mitigates or arrests the flow of current through the PTC element. Subsequently, when the PTC material cools (e.g., when the overcurrent condition subsides), the resistance of the PTC material decreases, and the PTC element becomes conductive again. The PTC element thus acts as a resettable fuse. Since the PTC element does not physically open in the manner of a fusible element, there is no opportunity for an electrical arc to form or propagate.

While PTC elements have proven to be effective for providing overcurrent protection in circuits while mitigating electrical arcing, they are associated with several shortcomings. For example, high voltage PTC elements typically have low conductivity, making them unsuitable for high current applications (e.g., 25-40 A hold current). Furthermore, PTC elements are prone to fail in an unpredictable manner when subjected to extreme fault conditions. For example, if a PTC element is subjected to an amount of current well above its rated capacity, the PTC element may, in some cases, fail in a manner that results in the PTC element becoming highly conductive and allowing the overcurrent to flow to connected devices (i.e., failing in a closed state, or "failing closed"). An extreme overcurrent condition may also result in combustion of the PTC element, potentially causing damage to surrounding components.

In view of the foregoing, it is desirable to provide a high voltage, high current circuit protection device that leverages the arc-mitigating benefits of a PTC element while ensuring that extreme fault conditions do not cause the PTC element to fail in a dangerous or catastrophic manner. It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A circuit protection device in accordance with an exemplary embodiment of the present disclosure include a positive temperature coefficient (PTC) device including a PTC element, an electrically conductive first electrode disposed on a first surface of the PTC element, and an electrically conductive second electrode disposed on a second surface of the PTC element opposite the first surface. The circuit protection device may further include a first chip fuse including a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the first electrode of the PTC device and wherein the first terminal electrode is electrically connected to the interface electrode by a via extending through the dielectric substrate, the first chip fuse having a lower electrical resistance than the PTC element when the PTC element is in a non-tripped state. The circuit protection device may further include a second chip fuse including a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the second electrode of the PTC device and wherein the first terminal electrode is electrically connected to the interface electrode by a via extending through the dielectric substrate. The circuit protection device may further include a first electrically conductive lead extending from the first terminal electrode of the first chip fuse, a second electrically conductive lead extending from the second terminal electrode of the second chip fuse, and a third electrically conductive lead connecting the second terminal electrode of the first chip fuse to the second electrically conductive lead.

A circuit protection device in accordance with another exemplary embodiment of the present disclosure include a positive temperature coefficient (PTC) device including a PTC element, an electrically conductive first electrode disposed on a first surface of the PTC element, and an electrically conductive second electrode disposed on a second surface of the PTC element opposite the first surface. The circuit protection device may further include a first chip fuse including a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the first electrode of the PTC device and wherein the first terminal electrode is electrically connected to the interface electrode by a via extending through the dielectric substrate, the first chip fuse having a lower electrical resistance than the PTC element when the PTC element is in a non-tripped state. The circuit protection device may further include a second chip fuse including a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the second electrode of the PTC device and wherein the first terminal electrode is electrically connected to the interface electrode by a via extending through the dielectric substrate, wherein the second terminal electrode of the second chip fuse is electrically connected to the second terminal electrode of the first chip fuse, wherein the fusible element of the first chip fuse has a first melting temperature $T_{m1}$ and is configured to carry a current higher than the PTC element can carry without tripping, and wherein the fusible element of the second chip fuse has a second melting temperature $T_{m2}$ that is greater than the first melting temperature $T_{m1}$ of the fusible element of the first chip fuse.

DETAILED DESCRIPTION

An exemplary embodiment of a circuit protection device in accordance with the present disclosure will now be described more fully hereinafter with reference to the accompanying drawings. The circuit protection device may, however, be embodied in many different forms and should not be construed as being limited to the embodiments set forth herein. Rather, these embodiments are provided so that this disclosure will convey certain exemplary aspects of the circuit protection device to those skilled in the art.

Figure 1:
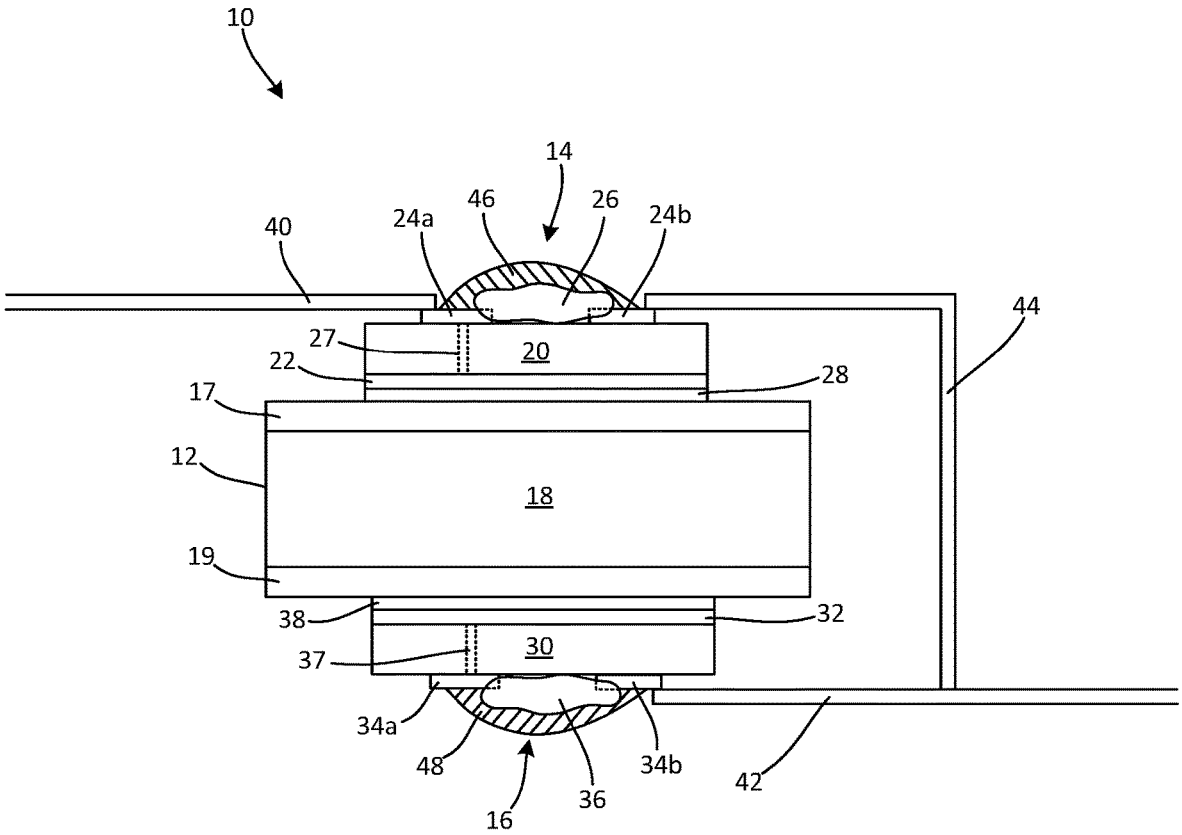
FIG. 1 is a cross-sectional side view illustrating a circuit protection device in accordance with an exemplary embodiment of the present disclosure.

Referring to FIG. 1, a side view illustrating a circuit protection device 10 (hereinafter "the device 10") in accordance with an exemplary embodiment of the present disclosure is shown. The device 10 may generally include a positive temperature coefficient (PTC) device 12 and first and second chip fuses 14, 16. For the sake of convenience and clarity, terms such as "front," "rear," "top," "bottom," "up," "down," "above," "below," etc. may be used herein to describe the relative placement and orientation of various components of the device 10, each with respect to the geometry and orientation of the device 10 as it appears in FIG. 1. Said terminology will include the words specifically mentioned, derivatives thereof, and words of similar import.

The PTC device 12 may be a laminate structure that generally includes a PTC element 18 having electrically conductive first and second electrodes 17, 19 disposed on opposing surfaces (e.g., top and bottom surfaces) thereof. The first and second electrodes 17, 19 may be formed of any suitable, electrically conductive material, including, but not limited to, copper, gold, silver, nickel, tin, etc. The PTC element 18 may be formed of any type of PTC material (e.g., polymeric PTC material, ceramic PTC material, etc.) formulated to have an electrical resistance that increases as the temperature of the PTC element 18 increases. Particularly, the PTC element 18 may have a predetermined "trip temperature" above which the electrical resistance of the PTC element 18 rapidly and drastically increases (e.g., in a nonlinear fashion) in order to substantially arrest current passing therethrough. In a non-limiting, exemplary embodiment of the device 10, the PTC element 18 may have a trip temperature in a range of 80 degrees Celsius to 130 degrees Celsius.

The first chip fuse 14 may include a substantially planar dielectric substrate 20 having an electrically conductive interface electrode 22 disposed on a bottom surface thereof, electrically conductive first and second terminal electrodes 24*a*, 24*b* disposed on a top surface thereof in a spaced apart relationship, and a fusible element 26 extending between the first and second terminal electrodes 24*a*, 24*b*. The interface electrode 22 may be flatly bonded to the first electrode 17 of the PTC device 12 by solder 28 or other electrically and thermally conductive medium (e.g., electrically/thermally conductive paste). The first terminal electrode 24*a* may be electrically connected to the interface electrode 22 by a via 27 extending through the dielectric substrate 20.

The dielectric substrate 20 may be formed of a low surface energy, electrically insulating, thermally resistant material. Examples of such materials include, but are not limited to, perfluoroalkoxy (PFA), ethylene tetrafluoroethylene (ETFE), or polyvinylidene fluoride (PVDF). The fusible element 26 may be formed of a quantity of solder that is disposed on the top surface of the dielectric substrate 20, bridging the first and second terminal electrodes 24*a*, 24*b* to provide an electrical connection therebetween. The solder from which the fusible element 26 is formed may have a first melting temperature $T_{m1}$ and may be configured to carry a current higher than the PTC element 18 can carry without tripping. In a particular example, the fusible element 26 may have a first melting temperature $T_{m1}$ of 142 degrees Celsius at 40 A and 600V. In various examples, the first melting temperature $T_{m1}$ may be in a range of 80 degrees Celsius to 260 degrees Celsius. The present disclosure is not limited in this regard. In any case, the electrical resistance of the fusible element 26 may be significantly lower than that of the PTC element 18 when the PTC element 18 is in a normal, non-tripped state.

The second chip fuse 16 may be similar to the first chip fuse 14 and may include a substantially planar dielectric substrate 30 having an electrically conductive interface electrode 32 disposed on a top surface thereof, electrically conductive first and second terminal electrodes 34*a*, 34*b* disposed on a bottom surface thereof in a spaced apart relationship, and a fusible element 36 extending between the first and second terminal electrodes 34*a*, 34*b*. The first terminal electrode 34*a* may be electrically connected to the interface electrode 32 by a via 37 extending through the dielectric substrate 30. The interface electrode 32 may be flatly bonded to the second electrode 19 of the PTC device 12 by solder 38 or other thermally conductive medium (e.g., thermally conductive paste 38).

The dielectric substrate 30 may be formed of a low surface energy, electrically insulating, thermally resistant material. Examples of such materials include, but are not limited to, perfluoroalkoxy (PFA), ethylene tetrafluoroethylene (ETFE), or polyvinylidene fluoride (PVDF). The fusible element 36 may be formed of a quantity of solder that is disposed on the bottom surface of the dielectric substrate 30, bridging the first and second terminal electrodes 34*a*, 34*b* to provide an electrical connection therebetween. The solder from which the fusible element 36 is formed may have a second melting temperature $T_{m2}$ that is greater than the first melting temperature $T_{m1}$ of the fusible element 26. In various examples, the second melting temperature $T_{m2}$ may be in a range of 1 degree Celsius to 100 degrees Celsius higher than the first melting temperature $T_{m1}$ of the fusible element 26. The present disclosure is not limited in this regard. The second melting temperature $T_{m2}$ may be achieved in the fusible element 36 as a result of heat emanated from the PTC element 18 when the PTC element 18 is tripped as further described below.

A first electrically conductive lead 40 may extend from the first terminal electrode 24*a* of the first chip fuse 14, and a second electrically conductive lead 42 may extend from the second terminal electrode 34*a* of the second chip fuse 16. A third electrically conductive lead 44 may connect the second terminal electrode 24*b* of the first chip fuse 14 to the second electrically conductive lead 42. Configured thusly, the first and second electrically conductive leads 40, 42 may facilitate electrical connection of the device 10 within a circuit, and the third electrically conductive lead 44 may establish an electrically parallel relationship between the first chip fuse 14 and the serially connected PTC device 12 and second chip fuse 16.

In various embodiments, the fusible elements 26, 36 of the first and second chip fuses 14, 16 may be covered with respective dielectric passivation layers 46, 48 for shielding the fusible elements 26, 36 from external contaminants and preventing short-circuiting with external components. The passivation layers 46, 48 may be formed of epoxy, polyimide, etc. or other material that may exhibit a "de-wetting" characteristic with respect to the fusible elements 26, 36 as further described below.

The solder from which the fusible elements 26, 36 are formed and the material from the which the dielectric substrates 20, 30 are formed may be selected such that, when the solder is in a melted or semi-melted state, the solder may have an aversion to, or a tendency to draw away from or to bead on, the surfaces of the dielectric substrates 20, 30. That is, the material of the dielectric substrates 20, 30 may exhibit a significant "de-wetting" characteristic relative to the respective solders from which the fusible elements 26, 36 are formed. In one example, one or both of the dielectric substrates 20, 30 may be formed of PFA and the solder of the respective fusible element(s) 26, 36 may be SAC305 solder. In another example, one or both of the dielectric substrates 20, 30 may be formed of ETFE and the solder of the respective fusible element(s) 26, 36 may be eutectic solder. In another example, one or both of the dielectric substrates 20, 30 may be formed of Fr-4, PI (polyimide) and the solder of the respective fusible element(s) 26, 36 may be a high melt solder (i.e., solder with a melting temperature above 260 degrees Celsius). The present disclosure is not limited in this regard.

During normal operation, the device 10 may be connected in a circuit (e.g., between a source of electrical power and a load) by the first and second electrically conductive leads 40, 42. Since the resistance of the fusible element 26 of the first chip fuse 14 is significantly lower than that of the PTC element 18 of the PTC device 12, current may flow through the device 10 along a path that includes the first electrically conductive lead 40, the first chip fuse 14, the third electrically conductive lead 44, and the second electrically conductive lead 42, entirely bypassing the PTC device 12 and the second chip fuse 16. In various embodiments, this path may be able to handle currents up to 40 A. The present disclosure is not limited in this regard.

Figure 2:
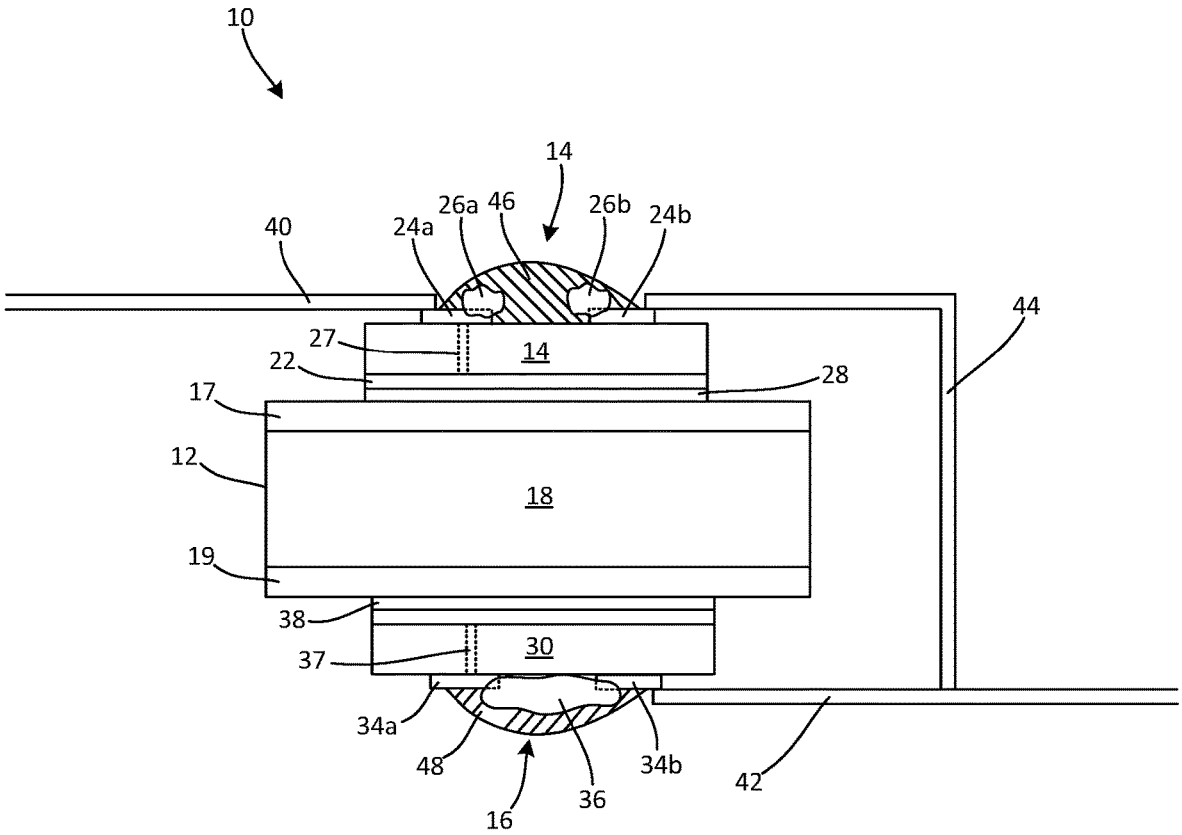
FIG. 2 is a cross-sectional side view illustrating the circuit protection device shown in FIG. 1 with the first chip fuse of the circuit protection device in an open state.

Upon the occurrence of an overcurrent condition, wherein current flowing through the device 10 exceeds to the current rating of the first chip fuse 14, the fusible element 26 of the first chip fuse 14 may melt or otherwise separate as shown in FIG. 2. The current is then diverted to flow through the only available alternate path, i.e., through the first electrically conductive lead 40, the first terminal electrode 24*a*, the via 27, and the interface electrode 22 of the first chip fuse 14, the PTC device 12, the second chip fuse 16, and the second electrically conductive lead 42. Since current is allowed to flow through this alternate path, electrical potential is not able to accumulate between the separated portions 26*a*, 26*b* of the melted fusible element 26, thereby precluding the formation and propagation of an electrical arc in the first disc fuse 14. Additionally, owning to the low surface energy of the dielectric substrate 20 and the aversive, "de-wetting" characteristic of the dielectric substrate 20 relative to the melted or semi-melted solder of the fusible element 26 (described above), the separated portions 26*a*, 26*b* of the fusible element 26 may draw away from one another and away from the surface of the dielectric substrate 20 and may accumulate on the terminal electrodes 24*a*, 24*b*, respectively, thereby providing a galvanic opening (i.e., a permanent, non-resettable opening) in the first chip fuse 14.

Figure 3:
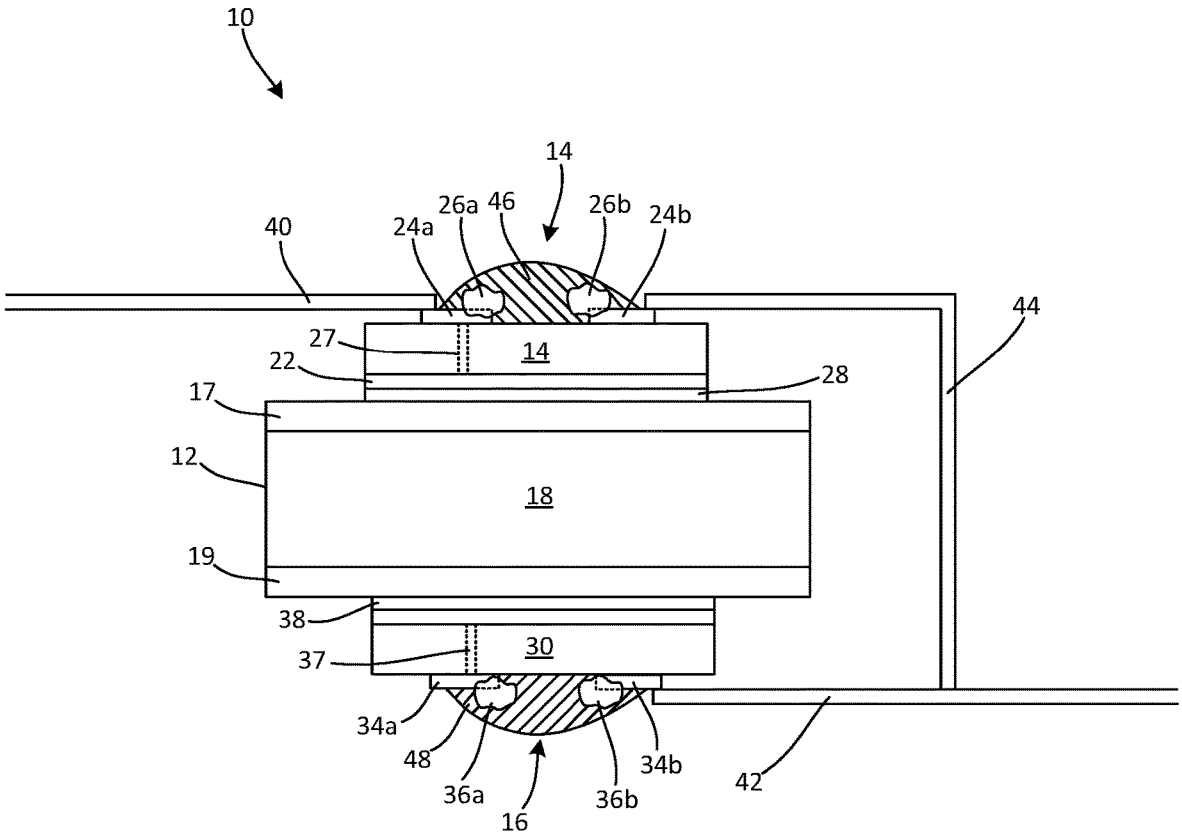
FIG. 3 is a cross-sectional side view illustrating the circuit protection device shown in FIGS. 1 and 2 with both the first chip fuse and the second chip fuse of the circuit protection device in an open state.

The persisting overcurrent flowing through the alternate path in the device 10 may cause the PTC element 18 to rapidly heat up and exceed its trip temperature, whereby the resistance of the PTC element 18 may rapidly increase and substantially arrest current flowing therethrough. Simultaneously (or substantially simultaneously), heat emanated by the PTC element 18 may cause the fusible element 36 of the second chip fuse 16 to melt and separate as shown in FIG. 3. Additionally, owning to the low surface energy of the dielectric substrate 30 and the aversive, "de-wetting" characteristic of the dielectric substrate 30 relative to the melted or semi-melted solder of the fusible element 36 (described above), the separated portions 36*a*, 36*b* of the fusible element 36 may draw away from one another and away from the surface of the dielectric substrate 30 and may accumulate on the terminal electrodes 34*a*, 34*b*, respectively, thereby providing a galvanic opening (i.e., a permanent, non-resettable opening) in the second chip fuse 16. Thus, even after the overcurrent condition subsides and the PTC element 18 cools to below its trip temperature and becomes conductive again, the separated portions 26*a*, 26*b* of the fusible element 26 provide and maintain galvanic opening in the device 10 such that current cannot flow through the device 10.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A circuit protection device comprising:

a positive temperature coefficient (PTC) device comprising a PTC element, an electrically conductive first electrode disposed on a first surface of the PTC element, and an electrically conductive second electrode disposed on a second surface of the PTC element opposite the first surface;

a first chip fuse comprising a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the first electrode of the PTC device and wherein the first terminal electrode is electrically connected to the interface electrode by a via extending through the dielectric substrate, the first chip fuse having a lower electrical resistance than the PTC element when the PTC element is in a non-tripped state;

a second chip fuse comprising a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the second electrode of the PTC device and wherein the first terminal electrode is electrically connected to the interface electrode by a via extending through the dielectric substrate;

a first electrically conductive lead extending from the first terminal electrode of the first chip fuse;

a second electrically conductive lead extending from the second terminal electrode of the second chip fuse; and a third electrically conductive lead connecting the second terminal electrode of the first chip fuse to the second electrically conductive lead.

2. The circuit protection device of claim 1, wherein the PTC element has a trip temperature in a range of 80 degrees Celsius to 130 degrees Celsius.

3. The circuit protection device of claim 1, wherein the dielectric substrate of the first chip fuse is formed of a low surface energy, electrically insulating, thermally resistant material.

4. The circuit protection device of claim 3, wherein the dielectric substrate of the first chip fuse is formed of one of perfluoroalkoxy (PFA), ethylene tetrafluoroethylene (ETFE), and polyvinylidene fluoride (PVDF).

5. The circuit protection device of claim 1, wherein the dielectric substrate of the second chip fuse is formed of a low surface energy, electrically insulating, thermally resistant material.

6. The circuit protection device of claim 5, wherein the dielectric substrate of the second chip fuse is formed of one of perfluoroalkoxy (PFA), ethylene tetrafluoroethylene (ETFE), and polyvinylidene fluoride (PVDF).

7. The circuit protection device of claim 1, wherein the fusible element of the first chip fuse is formed of solder disposed on the second surface of the dielectric substrate of the first chip fuse, bridging the first and second terminal electrodes of the first chip fuse.

8. The circuit protection device of claim 7, wherein the solder of the fusible element of the first chip fuse has a first melting temperature $T_{m1}$ and is configured to carry a current higher than the PTC element can carry without tripping.

9. The circuit protection device of claim 8, wherein the first melting temperature $T_{m1}$ is in a range of 80 degrees Celsius to 260 degrees Celsius.

10. The circuit protection device of claim 8, wherein the fusible element of the second chip fuse is formed of solder disposed on the second surface of the dielectric substrate of the second chip fuse, bridging the first and second terminal electrodes of the second chip fuse.

11. The circuit protection device of claim 10, wherein the solder of the fusible element of the second chip fuse has a second melting temperature $T_{m2}$ that is greater than the first melting temperature $T_{m1}$ of the fusible element of the first chip fuse.

12. The circuit protection device of claim 11, wherein the second melting temperature $T_{m2}$ in a range of 1 degree Celsius to 100 degrees Celsius higher than the first melting temperature $T_{m1}$.

13. A circuit protection device comprising:

a positive temperature coefficient (PTC) device comprising a PTC element, an electrically conductive first electrode disposed on a first surface of the PTC element, and an electrically conductive second electrode disposed on a second surface of the PTC element opposite the first surface;

a first chip fuse comprising a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the first electrode of the PTC device and wherein the first terminal electrode is electrically connected to the interface electrode by a via extending through the dielectric substrate, the first chip fuse having a lower electrical resistance than the PTC element when the PTC element is in a non-tripped state; and a second chip fuse comprising a dielectric substrate, an electrically conductive interface electrode disposed on a first surface of the dielectric substrate, first and second terminal electrodes disposed on a second surface of the dielectric substrate opposite the first surface of the dielectric substrate in a spaced apart relationship, and a fusible element extending between the first and second terminal electrodes, wherein the interface electrode is bonded to the second electrode of the PTC device and wherein the first terminal electrode is electrically connected to the interface electrode by a via extending through the dielectric substrate, wherein the second terminal electrode of the second chip fuse is electrically connected to the second terminal electrode of the first chip fuse;

wherein the fusible element of the first chip fuse has a first melting temperature $T_{m1}$ and is configured to carry a current higher than the PTC element can carry without tripping, and wherein the fusible element of the second chip fuse has a second melting temperature $T_{m2}$ that is greater than the first melting temperature $T_{m1}$ of the fusible element of the first chip fuse.

14. The circuit protection device of claim 13, wherein the PTC element has a trip temperature in a range of 80 degrees Celsius to 130 degrees Celsius.

15. The circuit protection device of claim 13, wherein the dielectric substrate of the first chip fuse is formed of a low surface energy, electrically insulating, thermally resistant material.

16. The circuit protection device of claim 15, wherein the dielectric substrate of the first chip fuse is formed of one of perfluoroalkoxy (PFA), ethylene tetrafluoroethylene (ETFE), and polyvinylidene fluoride (PVDF).

17. The circuit protection device of claim 13, wherein the dielectric substrate of the second chip fuse is formed of a low surface energy, electrically insulating, thermally resistant material.

18. The circuit protection device of claim 17, wherein the dielectric substrate of the second chip fuse is formed of one of perfluoroalkoxy (PFA), ethylene tetrafluoroethylene (ETFE), and polyvinylidene fluoride (PVDF).

19. The circuit protection device of claim 13, wherein the fusible element of the first chip fuse is formed of solder disposed on the second surface of the dielectric substrate of the first chip fuse, bridging the first and second terminal electrodes of the first chip fuse.

20. The circuit protection device of claim 13, wherein the fusible element of the second chip fuse is formed of solder disposed on the second surface of the dielectric substrate of the second chip fuse, bridging the first and second terminal electrodes of the second chip fuse.

* * * * *